US005676316A

United States Patent [19]

Hanna

[11] Patent Number: 5,676,316

[45] Date of Patent: Oct. 14, 1997

[54] SMOKING MATERIAL EXTINGUISHER

[76] Inventor: Deanna Hanna, 3510 Can-Ada Rd., Nampa, Id. 83687

[21] Appl. No.: 516,760

[22] Filed: Aug. 18, 1995

[51] Int. Cl.[6] ..... B02C 19/00; B02C 19/12

[52] U.S. Cl. ..... 241/22; 241/23; 241/100; 241/260.1; 241/DIG. 38

[58] Field of Search ..... 241/17, 22, 23, 241/100, 260.1, 261, DIG. 38, 99

[56] References Cited

U.S. PATENT DOCUMENTS

| | | | |
|---|---|---|---|
| 1,331,872 | 2/1920 | Plucker | 241/100 X |
| 3,750,966 | 8/1973 | Anderson | 241/99 |
| 3,987,972 | 10/1976 | Gladwin | 241/99 |
| 4,655,404 | 4/1987 | Deklerow | 241/99 |
| 5,102,057 | 4/1992 | Ellis, III | 241/99 |
| 5,397,068 | 3/1995 | Solomons et al. | 241/100 |

*Primary Examiner*—John M. Husar
*Attorney, Agent, or Firm*—Thorpe, North & Western, L.L.P.

[57] ABSTRACT

A device for extinguishing and disposing of cigarettes, cigars, or other similar smoking materials is provided. The device employs cutter bars which draw in and grind up the cigarette, cigar, or other similar smoking material into a coarse residue. Further, an extinguishing material is utilized to extinguish the cigarette, cigar or other smoking material. The extinguishing material may also act as a deodorizer or an additional deodorizing element may be incorporated. In addition, a fan to draw smoke emanating from the smoking material and through a deodorizing filter may be employed to deodorized the smoke produced and thus provide for discharge of deodorized air from the device. In this way, the inventive device serves to extinguish, deodorize, and grind the cigarette, cigar, or other similar smoking material into a substantially odorless residue which is more easily assimilated back into the environment.

24 Claims, 8 Drawing Sheets

SMOKING MATERIAL EXTINGUISHER

BACKGROUND

1. The Field of the Invention

The present invention relates to apparatus for use in extinguishing smoking materials and more specifically to a portable system for extinguishing and deodorizing smoking materials and containing the waste for later disposal.

2. The Background Art

A variety of devices in which to extinguish and contain the remains of cigarettes, cigars, and other similar smoking materials have developed. The simplest of these is likely the ash tray which employs a tray atop a, preferably weighted, base. The tray serves as a bed in which the cigarette, cigar or other similar smoking material can be extinguished by pressing the lighted end firmly onto the tray. The remaining butt is then tossed into the tray for later disposal. When the tray is full, or approaching full, the extinguished butts are discarded. Typically, the tray is dumped into a trash receptacle.

Unfortunately, the ash tray has a number of inherent problems which make it a less than optimal solution to disposing of cigarettes, cigars, and similar smoking materials. For instance, pressing a lighted cigarette against the tray of the ash tray to extinguish it typically results in the release of a pillar of smoke. This smoke results in unnecessary air pollution since it occurs without benefit to the smoker of the cigarette, cigar, or other smoking material. Recent studies on the detriments of smoking and second hand smoke lend weight to the desire to prevent as much smoke as possible from entering the atmosphere. This is particularly true indoors where the release of any smoke into the atmosphere can have a noticeable effect.

An additional drawback to the use of conventional ash trays is that disposal of the extinguished butts in a trash receptacle can have undesirable results. It is not unusual for the user of an ash tray to notice that the tray is approaching capacity upon attempting to use the ash tray. The user may then choose to discard the contents of the ash tray shortly after using it to extinguish a lighted cigarette, cigar, or other similar smoking material. As will be appreciated, extinguishing a cigarette, cigar, or other similar smoking material by pressing firmly against a tray is an imprecise and imperfect way to accomplish complete extinguishment. A cigarette, cigar, or other similar smoking material extinguished in this manner may, therefor, not be completely extinguished. Disposal of a partially extinguished cigarette, cigar, or other similar smoking material into a trash receptacle can therefore result in conflagration. This is particularly true in the event that the trash receptacle into which the cigarette, cigar, or other similar smoking material is discarded contains paper, or other easily combustible materials.

The drawbacks of a simple ashtray have led to the development of other devices. Many of these devices are directed to the extinguishment of cigarettes, cigars, or similar smoking materials. Devices which press the cigarette, cigar, or similar smoking material between rollers are one such device. Unfortunately, this type of extinguishment still leaves the extinguished butt of the cigarette, cigar, or other smoking material to deal with. Devices which extinguish cigarettes, cigars, or other smoking materials by spray application of liquids are also known. These devices tend to be rather elaborate.

Other devices have been directed to the disposal of the remaining cigarette, cigar, or similar smoking material.

Devices which pulverize the remaining cigarette, cigar, or similar smoking material have developed. These device are typically aimed at creating a residue which can be disposed directly into the environment. For example, disposing of the pulverized residue directly onto a paved roadway from a vehicle. Unfortunately, these devices do nothing to deodorize the residue from the cigarette, cigar, or other smoking material.

Other devices have developed to make certain that cigarettes, cigars, or other similar smoking materials have been completely extinguished and to thereby avoid the release of additional smoke or the potential for conflagration.

In addition to failing to adequately combine the features of containing smoke and assuring complete extinguishment, such devices also overlook the opportunity to neutralize the odor associated with the waste materials of cigarettes, cigars, and similar smoking materials.

It would therefore be an advantage in the art to provide a portable device which would extinguish a cigarette, cigar, or other smoking material, deodorize the residue, and reduce the residue to a form more easily assimilated back into the environment.

BRIEF SUMMARY AND OBJECTS OF THE INVENTION

In view of the above described state of the art, the present invention seeks to realize the objects and advantages discussed below by providing a device as described briefly herein.

A portable device for extinguishing cigarettes, cigars, or similar smoking materials is provided. In a presently preferred embodiment the inventive extinguishing device employs rollers, having cutting surfaces thereon, to grind the discarded portion of the cigarette, cigar, or other smoking material. Concurrently, a water based or flame retardant gel is admixed with the ground up portion of the cigarette, cigar, or other similar smoking material. This residue is then dropped into a receptacle containing charcoal. The charcoal acts to deodorize the residue and contain the associated odors. The receptacle contains the residue for later disposal.

Additionally, in at least one embodiment, the device provides for the deodorizing of the smoke emanating from cigarettes, cigars, or other similar smoking materials which are at rest on the device. The inventive device utilizes a fan which pulls the smoke down into the device and through an activated charcoal filter or other deodorizing material, thus discharging substantially deodorized air into the surrounding atmosphere.

Accordingly, it is a primary object of the present invention to provide a system for disposing of discarded cigarettes, cigars, or other similar smoking material which deodorizes the resulting refuse.

It is a further object of the present invention to reduce the discarded cigarette, cigar, or other similar smoking material to a ground residue which will be more easily assimilated back into the environment.

It is a still further object of the present invention to provide a system which extinguishes the cigarette, cigar, or other similar smoking material upon its disposal thereby reducing excess smoke released to the atmosphere.

It is an additional object of the present invention to provide a system for extinguishing and disposing of cigarettes, cigars, or other similar smoking materials which is portable and adaptable for use in a variety of environments including public buildings and vehicles.

It is another object of the present invention to provide a device for disposal of cigarettes, cigars, or other similar smoking materials which is capable of substantially eliminating and deodorizing the associated smoke present during use, prior to disposal of the butt or unused portion.

These and other objects and features of the present invention will become more fully apparent from the following description and appended claims, taken in conjunction with the accompanying drawings.

BRIEF DESCRIPTION OF THE DRAWINGS

In order to more fully understand the manner in which the above-recited and other advantages and objects of the present invention are obtained, a more particular description of the invention briefly described above will be rendered by reference to the presently understood best mode for making and using the same, as illustrated in the appended drawings. Understanding that these drawings depict only typical embodiments of the invention and are, therefore, not to be considered limiting of its scope, the invention will be described with additional specificity and detail through the use of the accompanying drawings in which.

DETAILED DESCRIPTION OF THE PREFERRED EMBODIMENTS

It will be readily appreciated that the components of the present invention, as generally described and illustrated in the figures herein, could be arranged and designed in a wide variety of different configurations. Thus, the following more detailed description of an embodiment of the system and method of the present invention, as represented in FIGS. 1 through 7, is not intended to limit the scope of the invention as claimed, but it is merely representative of the presently preferred embodiments of the invention. Additionally, the accompanying discussion of alternative embodiments is not intended to limit the scope of the invention as claimed, but is merely illustrative of other options and implementations.

Figure 1:
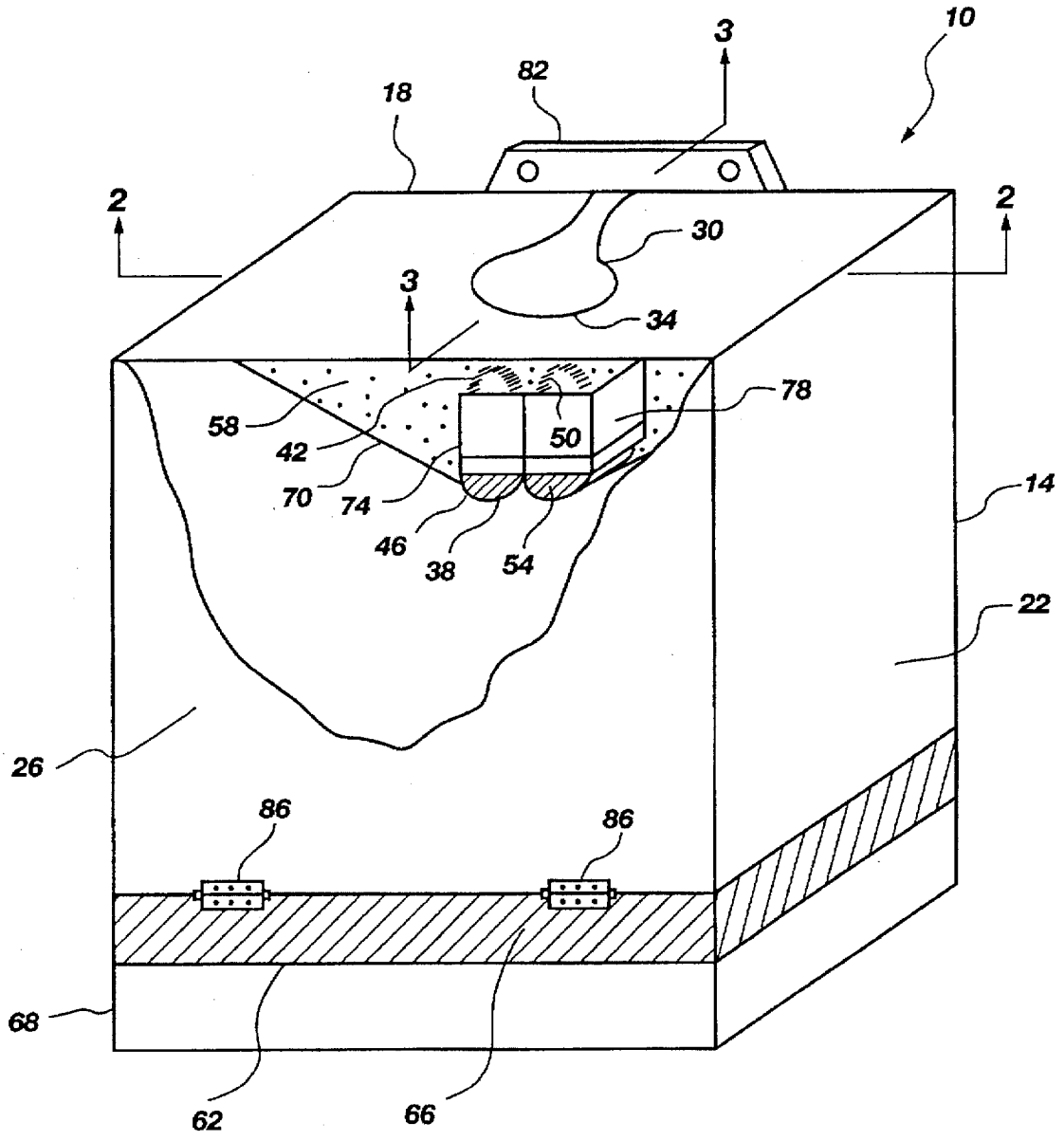
FIG. 1 depicts a perspective view of a wall mounted embodiment of the present invention, a portion of the body is shown in cutaway so that the internal configuration of the inventive smoking material extinguisher can be viewed.

Reference is now made to the embodiments illustrated in FIGS. 1 through 7 wherein like numerals are used to designate like parts throughout. FIG. 1 depicts a preferred embodiment of the inventive extinguishing device shown generally at 10. As shown, body 14 of extinguishing device 10 is generally rectangular in shape. In this view, top surface 18, right side surface 22, and front surface 26 of body 14 are visible.

Attached to top surface 18 of body 14 is a tab 30 which is so sized and configured as to cover opening 34 formed in top surface 18. Tab 30 may be removed from opening 34 to allow a cigarette, cigar, or other similar smoking material to be placed therein. When extinguishing device 10 is not in use, tab 30 can be moved into position over opening 34. Tab 30 serves to substantially seal off communication of air and odors between extinguishing device 10 and the surrounding atmosphere.

A cigarette, cigar or other smoking material moving through extinguishing device 10 next encounters cutter bars 38. Cutter bars 38 mesh together and counter rotate beside one and other so as to grind the discarded portion of the cigarette, cigar, or other smoking material leaving a coarse residue. Cutter bars 38 employ an upper conical portion 42 and a cylindrical lower portion 46.

As shown, ridges 50 are incorporated on the upper conical portion 42 and blades 54 on the lower cylindrical portion 46. The conical portion 42 and ridges 50 serve to feed the cigarette, cigar, or other similar smoking material into blades 54 where the actual grinding takes place by the counter rotating bars. This serves as a safety mechanism to reduce the chances of a child accidentally inserting a finger into the device and being injured.

Additional safety features may also be incorporated. For instance, blades 54 may be relatively dull. If cutter bars 38 are designed to fit tightly together less sharp cutting blades 54 can be used to accomplish the desired grinding. Other safety precautions may include mounting the device at such a height or in such a way that a child is unlikely to be able to inadvertently insert a finger into the device.

A flame retardant gel or other extinguishing material 58 may also be admixed with the coarse residue resulting from the grinding procedure. This resulting residue or admixture material then falls down onto base 62 or onto residue from prior materials which is already resting on base 62 which may contain a deodorizing material 66 such as activated charcoal.

Below base 62 is fan housing 68 which contains a fan (not shown). The fan acts to pull any smoke through base deodorizing material 66. Thus the system releases only substantial deodorized air into the surrounding environment.

In a preferred embodiment, the cigarette, cigar, or other similar smoking material would be contacted by diatomaceous earth used as the extinguishing material 58. Diatomaceous earth also acts as a natural deodorizer so that deodorizing material 66 may not be necessary. If, however, a large quantity of material is expected to be stored between disposals it is preferred to incorporated deodorizing material 66 into base 62 so as to achieve the maximum deodorizing effect.

As shown, the flame retardant gel or other extinguishing material 58 which the cigarette, cigar, or other similar smoking material first encounters is contained in the receptacle formed between top surface 18 of body 14 and slanted plates 70. Left hand partial wall 74 and right hand partial wall 78 control the amount of flame retardant gel or other extinguishing material 58 which comes into contact with a cigarette, cigar, or other similar smoking material and with cutter bars 38.

By adjusting left hand partial wall 74 and right hand partial wall 78 to be longer and shorter the surface area of gel contacting cutter bars 38 can be decreased or increased respectively. Adjustments in the amount of flame retardant gel or other extinguishing material 58 contacting cutter bars 38 may be advantageous based on the viscosity of the flame retardant gel or other extinguishing material 58 utilized. If a highly viscous gel is employed, a larger surface area may be useful in applying the desired amount of gel. A gel with a low viscosity, and therefore more free flowing, may require less surface area in contact with cutter bars 38 to achieve the desired application of gel.

Left hand partial wall 74 and right hand partial wall 78 can also incorporate openings (not shown). Such openings will allow for the flow of flame retardant gel 58 into cutter bars 38 so as to be admixed with the discarded portion of a cigarette, cigar, or other smoking material as it is ground into a residue.

In use, a cigarette, cigar, or other smoking material is inserted into opening 34 in top surface 18. A portion of the front surface 26 of body 14 has been cutaway so that cutter bars 38 are partially visible. Cutter bars 38 serve a dual purpose of grinding the cigarette, cigar, or other similar smoking material into a coarse residue material and mixing in a flame retardant gel or other extinguishing material 58 as desired.

The upper edge of hang tab 82 is also visible in FIG. 1. Hang tab 82 allows extinguishing device 10 to be mounted on a wall or other vertical surface. Hang tab 82 also provides for removal of body 14 so as to discard the smoking material and gel mixture.

Body 14 employs a slot, not shown which is designed to engage a ridge on hang tab 82, also not shown. The slot on body 14 and the ridge on hang tab 82 are complementary so that when the slot is positioned over the ridge, the ridge fits into the slot thereby engaging hang tab 82 with body 14.

To remove body 14 from hang tab 82 so as to empty residue or to service extinguishing device 10 the process is reversed. Grasping body 14 firmly and moving in an upward direction results in the slot of body 14 sliding up and off of the ridge of hang tab 82 thereby disengaging body 14 from hang tab 82. As will be appreciated, numerous other methods of engaging body 14 and hang tab 82 could be employed to achieve the same affect.

Once body 14 is disengaged is can be transported to a trash receptacle or other waste disposal site for disposal. In a preferred embodiment the water based gel admixed with the shavings of the cigarette, cigar, or other smoking material would be capable of being disposed in any trash or waste receptacle.

Special disposal procedures may be necessary, however, if a flame retardant gel incorporating chemicals requiring special handling is employed. If such is required it may be advantages to keep a supply of replacement parts, such as body 14, on hand. Since body 14 and hang tabs 82 can be made to be interchangeable, a fresh body 14 could be placed on hang tab 82 thereby allowing later disposal of the waste contained in the used body 14 while still providing for disposal of cigarettes, cigars, and other smoking materials at the location where hang tab 82 is installed.

Body 14 may is also constructed so as to be removable independently of cutter bars 38. This design allows for remove and replacement of body 14 when necessary to maintain the desired effect of the flame retardant gel. When the flame retardant gel or other extinguishing material has been depleted to the point that it is not acceptably effective, body 14 may be removed, discarded, and replaced.

It will be appreciated that it would also be possible to construct an embodiment such that the flame retardant gel or other extinguishing material could be replenished as desired. If diatomaceous earth is used as the extinguishing material, it may be necessary only to occasionally moisten the area of the extinguishing material to maintain the desired extinguishing effect.

In this embodiment, base 62 is attached to front surface 26 of body 14 by hinges 86. Base 62 is filled with a layer of activated charcoal or other odor absorbing or deodorizing materials 66. This layer of activated charcoal or other odor absorbing or deodorizing material 66 serves to substantially absorb or otherwise neutralize the odors incident to the residue of cigarettes, cigars, and other similar smoking materials.

If desired, a fan may be incorporated which will draw in smoke emanating from cigarettes cigars, or other similar smoking materials placed on device 10. By incorporating a fan, device 10 can be used to substantially eliminate the odors associated with smoke released into the atmosphere surrounding the cigarette, cigar, or other similar smoking material when the smoking material is lighted but not being actively utilized by the smoker. The smoke is drawn into device 10 and through an activated charcoal or other deodorizing filter, thus only deodorized air is released from the device into the surrounding atmosphere. Incorporation of a fan is discussed in further detail in relation to other embodiments of the present invention.

Base 62 may be opened by partial rotation around hinges 86. It will be appreciated that a number of opening mechanisms could be used to accomplish the same effect. For example, a continuous hinge could be employed as an alternate hinge mechanism. Additionally, other opening mechanisms employing means of sliding base 62 away from body 14 or otherwise detaching base 62 could be utilized.

When base 62 is opened the residue contained within body 14 can be disposed of in a trash receptacle or by other disposal means. Base 62 may also be removed and replaced as necessary.

Figure 2:
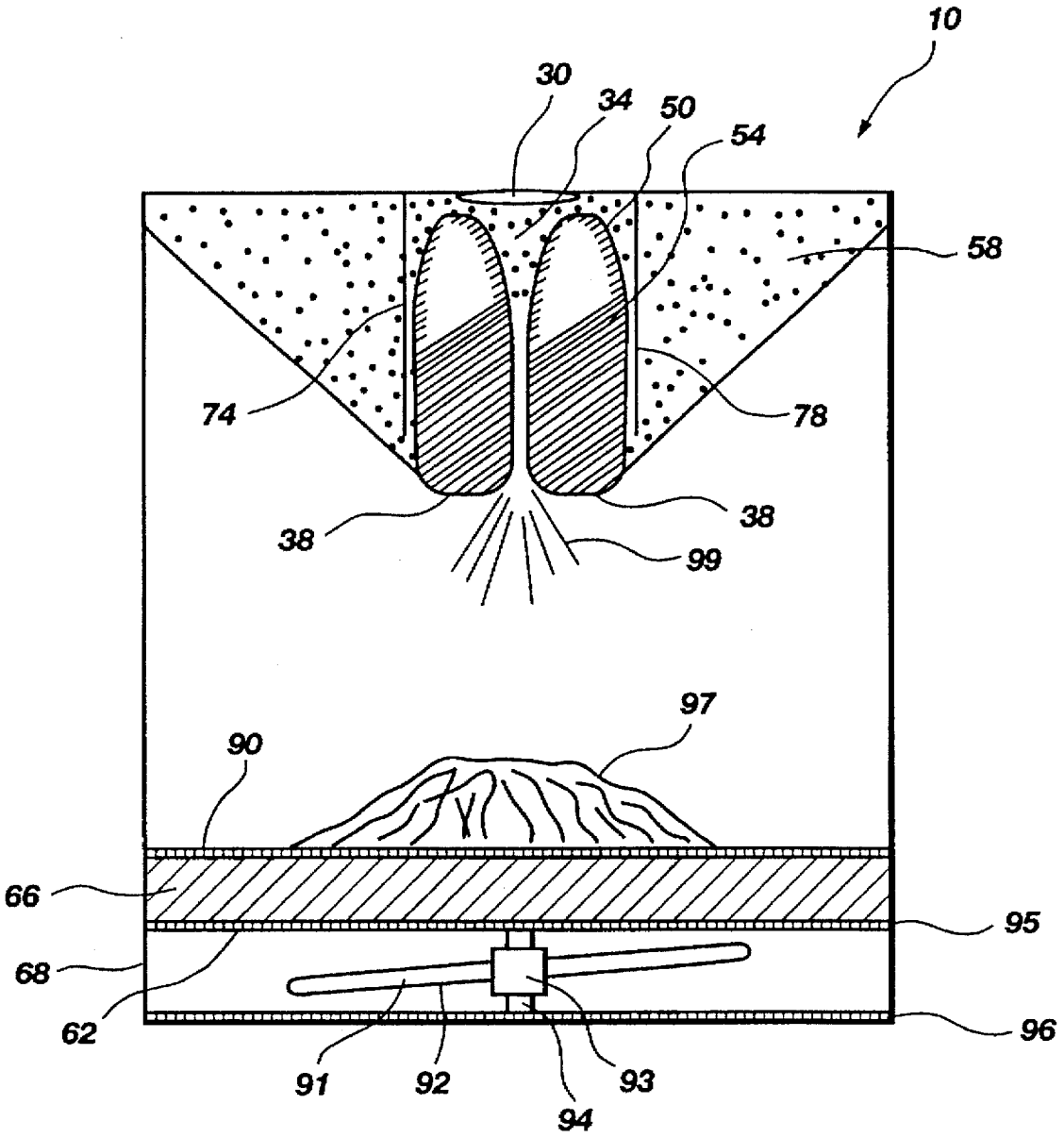
FIG. 2 is a cross sectional view of the wall mounted embodiment of the inventive device depicted in FIG. 1 being taken along lines 2—2 of FIG. 1.

Turning to FIG. 2, in cross sectional view several aspects of the present inventive device are better illustrated. First, the layer of material 90 which serves to hold the deodorizing or odor absorbing material 66 in place in base 62 is depicted. Material 90 is attached along the entire perimeter of base 62 so as to substantially seal the deodorizing or odor absorbing material 66 into base 62. Material 90 is preferably made of a fine mesh or netting material so as to allow substantial circulation of air and odors through deodorizing or odor absorbing material 66.

Further, fan 92 enclosed in fan housing 68 is illustrated generally at 92. Fan 92 employs fan blades 91 which are rotated by the action of fan motor 93 around shaft 94. Fan 92 is rotated such that fan blades 91 draw air through opening 34 when tab 30 is opened. This action results in the drawing in of substantially any smoke associated with a cigarette, cigar, or other similar smoking material which may be resting in the vicinity of opening 34.

The smoke which is drawn in is, necessarily, drawn through base deodorizing material 66 and then through top screen 95 by the action of fan 92. Finally, deodorized air is expelled through bottom screen 96. In this way, device 10 functions as an air deodorizer in addition to an extinguisher and disposal for cigarettes, cigars, and other similar smoking materials. Although fan 92 is generally preferred, it will be appreciated that the guiding and extinguishing features of device 10 do not require the incorporation of fan 92.

Additionally, the path of a cigarette, cigar, or other similar smoking material through the device can be better appreciated. The cigarette, cigar, or other similar smoking material enters the device through opening 34 once tab 30 has been removed. Upon entering the device, the cigarette, cigar, or other similar smoking material is extinguished by the flame retardant gel or other extinguishing material 58.

Ridges 50 and blades 54 incorporated on cutter bars 38 are the next to be encountered as can clearly be seen in this illustration. Ridges 50 located on the top portion of the cutter bar serve to pull the cigarette, cigar, or other smoking material into the device. Ridges 50 are preferably of suitable length to avoid injury to a small child should such inadvertently place a finger into the device.

Continuing into the device, the cigarette, cigar, or other similar smoking material encounters the cutting ridges which serve to grind up the smoking material. In a preferred embodiment, the mechanism employed to grind the cigarette, cigar or other similar smoking material works in a fashion akin to that used by an electric pencil sharpener.

The ground material 99 falls from the bottom portion of the cutter bars 38 onto base 62 containing deodorizing material 66. In this depiction a number of cigarettes, cigars, or other similar smoking materials have been disposed of so that there exists an amount of residue 97 already contained within body 14 onto which the additional residue will fall.

Figure 3:
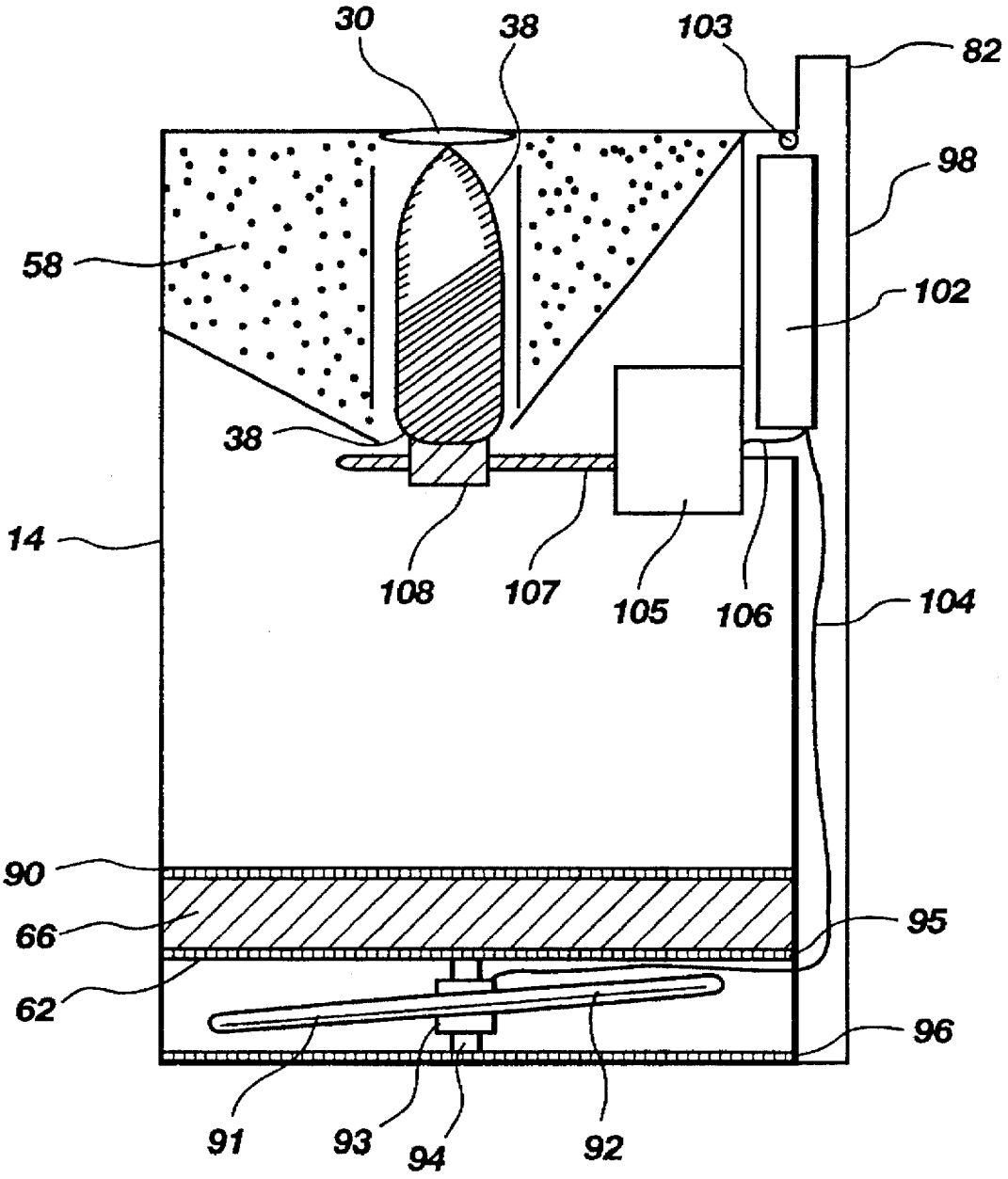
FIG. 3 is a cross sectional view of the wall mounted embodiment of the inventive device depicted in FIG. 1 being taken along lines 3—3 of FIG. 1.

Turning to FIG. 3, a side cross sectional view of the inventive device reveals the mounting plate 98 incorporating hang tab 82. As can be seen, a battery 102 is utilized to provide power. In a preferred embodiment, the device only becomes active when a cigarette, cigar, or other similar smoking material is present for disposal. In this way, the life of the battery is maximized.

It will also be appreciated that other means of supplying power could be utilized. For example the device could be wired into alternating current or direct current if available. Further, if desired, the inventive device could incorporate a battery charger so as to limit the number of times the battery would need to be replaced.

Also visible in this figure is the interaction between tab 30 and battery 102. Tab 30 is designed to flip up and out of the way when it is desired to dispose of a cigarette, cigar, or other similar smoking material. When tab 30 is displaced, contact 103 contacts battery 102 allowing power to become available to the device. This acts as both a power saver and a safety feature. When contact 103 engages battery 102 power is supplied to fan 92 through fan leads 104. Power is also supplied to cutter bar motor 105 through cutter bar motor leads 106. Cutter bar motor 105 operates to convert the electrical energy supplied by battery 102 to mechanical energy which rotates cutter base 38. The action of shaft 107 and gears 108 is such that cutter bars 38 counter rotate. In a preferred embodiment, shaft 107 and gears 108 would comprise a worm gear assembly to counter rotate cutter bars 38. As will be appreciated, other configurations of shaft 107 and gears 108 could be employed to counter rotate cutter bars 38.

Figure 4:
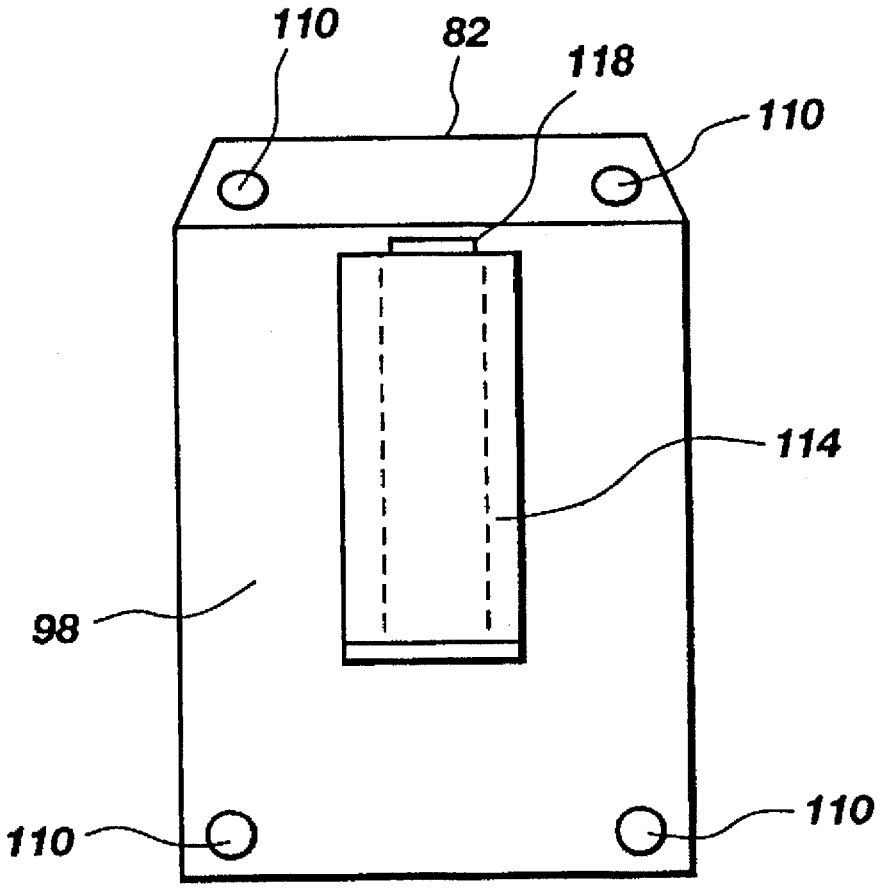
FIG. 4 is a rear view of the wall mounting bracket used to affix the wall mounted embodiment depicted in FIG. 1 to a wall or other surface.

Turning to FIG. 4, additional details of mounting plate 98 and hang tab 82 are visible. As depicted here a preferred mounting arrangement is to mount the device by the mounting holes 110 placed in each of the four corners of mounting plate 98. Although a preferred attachment device would employ screws sized to extend through mounting holes 110 it will be appreciated that a number of attachment means would be acceptable.

Also illustrated in this figure is power source cover 114. Power source cover 114 is removable by placing the tip of a screwdriver or other implement into slot 118 and prying upwards. Once power source cover 114 has been removed, the battery contained therein can be replaced. It will also be appreciated that a similar arrangement could be used to allow access to wires in situations utilizing a hardwired configuration.

Figure 5:
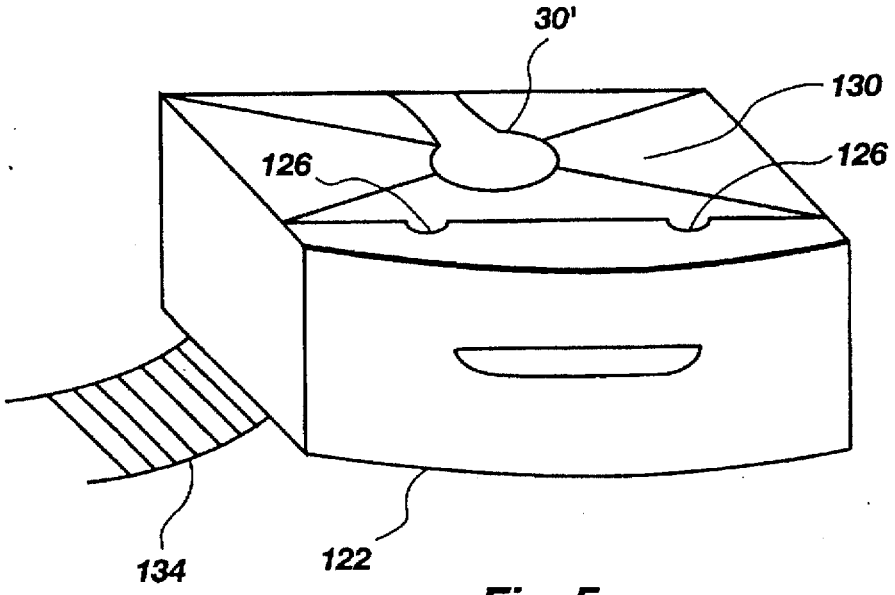
FIG. 5 is a perspective view of an embodiment of the present invention as it might appear in use as the ash tray of a vehicle.

Turning to FIG. 5, an embodiment of the present inventive device as incorporated in a typical vehicle ash tray is depicted. A typical extending drawer or tray type 122 ash tray compartment is illustrated. As shown, tab 30' is in place covering the opening to cutter bars (not shown). Cigarette rests 126 are also shown.

In use, a cigarette, cigar, or other similar smoking material can be placed on cigarette rest 126 during use. Ashes from the cigarette, cigar, or other similar smoking material will then fall into funneled area 130. When ready, tab 30' can be removed and the discarded portion of the cigarette, cigar, or other similar smoking material urged into the opening. The ashes resulting from smoking the cigarette, cigar, or other similar smoking material will also be inclined to move into the opening due to the slanted nature of funneled area 130.

In this illustration, disposal hose 134 can be seen extending from tray 122. The residue falling from the cutter bars would continue through disposal hose 134 and be deposited on the surface over which the vehicle is passing. This method encourages vehicle owners to utilize the ash trays provided in their vehicles, since there is not odorous refuse to deal with as there is in the use of a typical ash tray. This method of disposal has a number of advantages over a typically practiced alternate means of disposal, that of disposing of the discarded portion by flicking the butts of the cigarettes, cigars, or other similar smoking materials out of the window of the vehicle.

By running the discarded materials through the present inventive device, a ground material is placed back into the environment rather than the intact butt of a cigarette, cigar, or other similar smoking material. As will be appreciated, the ground residue is not unsightly as the butts are and the ground residue is also more easily assimilated back into the environment.

Figure 6:
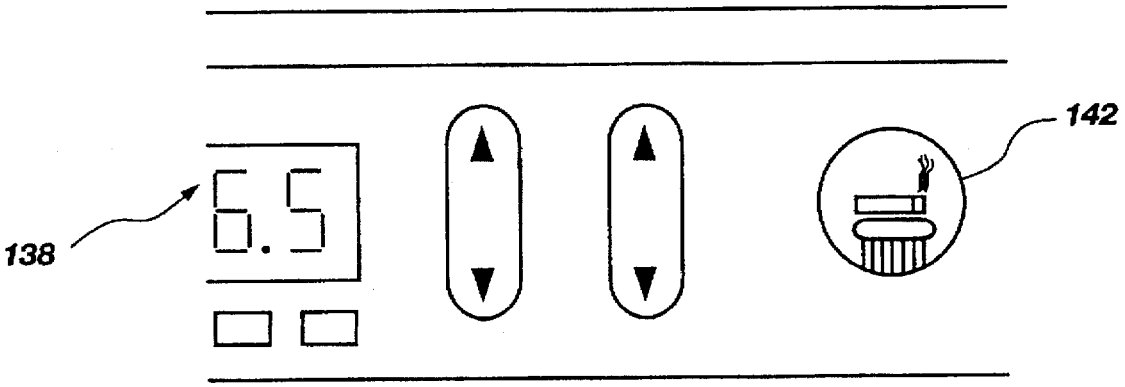
FIG. 6 is a front view of an embodiment illustrating how an embodiment of the present invention might be incorporated in stand alone fashion as part of the dash board of a vehicle.
Figure 7:
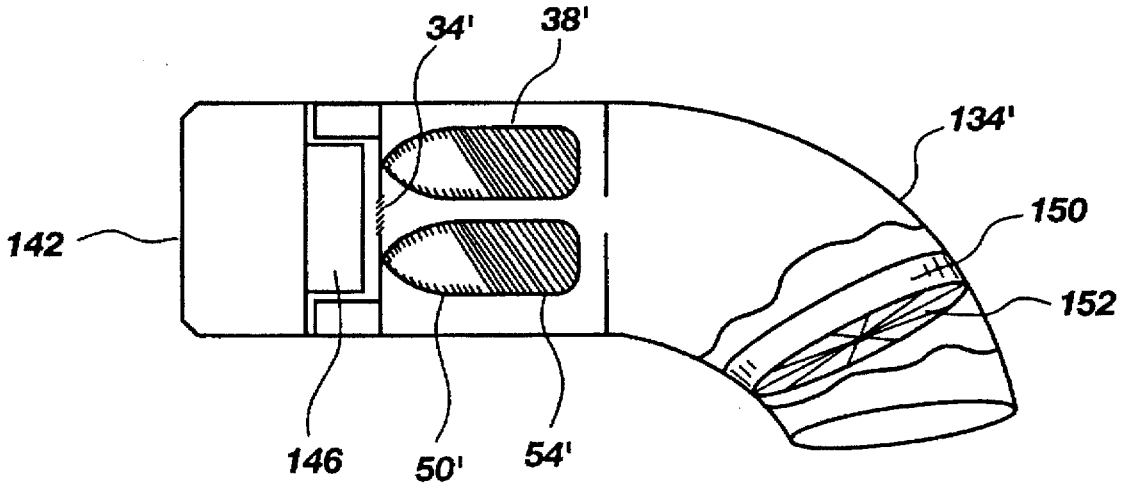
FIG. 7 is a cross sectional view of the embodiment also depicted in FIG. 6.

Turning to FIGS. 6 and 7 another embodiment designed for use in a vehicle is depicted. In FIG. 6 a portion of a dashboard typical to vehicles is depicted generally at 138. Various controls are shown. Knob 142 is shown as depicting a cigarette and the top of a trash can. Knob 142 covers an opening which provides for disposal of cigarettes, cigars, or other similar smoking materials according to the teachings of the present invention.

In FIG. 7, a side cross sectional view shows how knob 142 incorporates an extended portion 146 which serves to cover opening 34' when the disposal device is not in use. When knob 142 is removed, a cigarette, cigar, or other similar smoking material can be placed within opening 34'. The cigarette, cigar, or other similar smoking material is extinguished by the extinguishing material contained therein.

The cigarette, cigar, or other similar smoking material is then drawn into the device by ridges 50' as cutter bars 38' counter rotate. Blades 54' then grind the cigarette, cigar, or other similar smoking material into a residue which is deposited onto the surface over which the vehicle is traveling by disposal hose 134'. It will be appreciated that, if desired, disposal hose 134' could be replaced by a housing which could hold the residue for later disposal similar in nature to the embodiment discussed in relation to FIG. 1.

A portion of disposal hose 134' is shown cutaway to reveal fan 150. Fan 150 employs blades 152 which are designed to draw air and smoke through opening 34' into disposal hose 134' and discharge the air to the outside environment. Fan 150 is shown as a squirrel cage type fan but, as will be appreciated, a variety of fans could be used to accomplish the desired effect.

Figure 8:
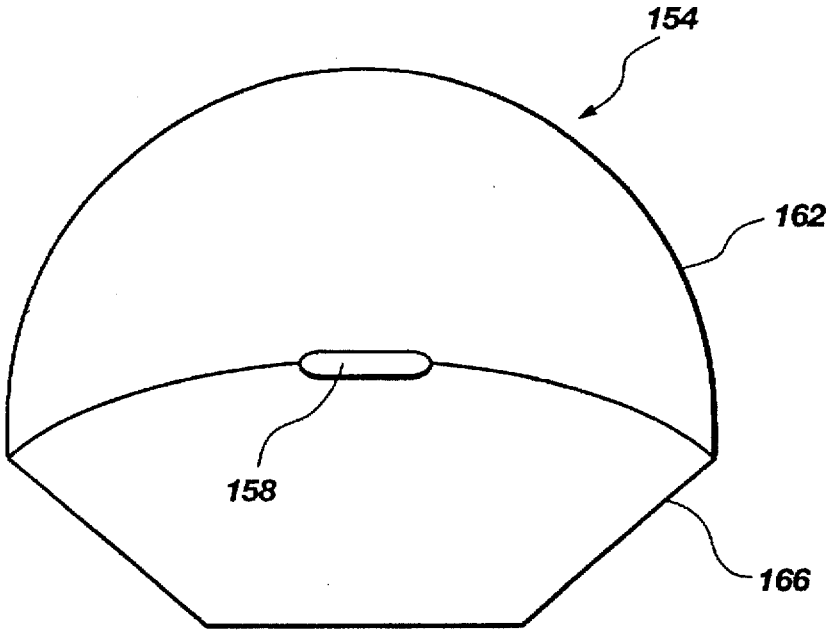
FIG. 8 is a front view of a covered embodiment of the present invention depicting the cover in the closed position.

Turning to FIG. 8, an alternate embodiment employing a cover is shown generally at 154. A clasp 158 serves to keep cover 162 closed and interlocked with base 166 when the smoking material extinguisher is not in use.

Clasp 158 is preferably spring loaded thereby being urged inward. In this configuration, catch 158 will naturally be forced out over base 166 following the contour of base 166. As cover 162 is moved downward toward base 166 and the closed position. When cover 162 is moved into a substantially closed position, catch 158 will automatically engage base 166.

To open cover 162, an outside force must be employed to force clasp 158 out slightly, against the spring force, so that clasp 158 disengages from base 166.

Figure 9:
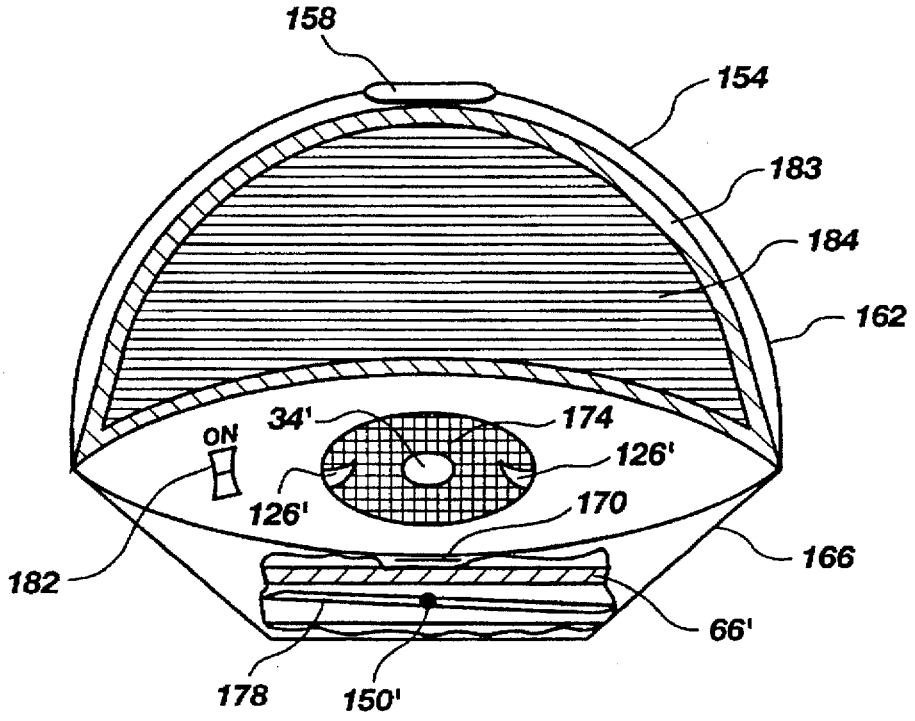
FIG. 9 is a front view of the covered embodiment of the present invention showing the cover in the open position.

Turning to FIG. 9, covered embodiment 154 is shown with cover 162 in an open position. In this embodiment, the action of moving cover 162 into an open position serves to turn fan 150' on. This is preferably accomplished through the use of a simple positive switch which is installed so as to make contact and allow power to fan 150' when the cover is moved into an open position. As will be appreciated, a number of other devices could be used to turn fan 150' on automatically when cover 162 is moved into the open position. As will also be appreciated, other configurations could be employed such as a switch, which would not be automatic, which would allow a user to turn fan 150' on and off as desired.

Detent 170, which clasp 158 engages and interlocks with when cover 162 is in the closed position, is shown. As illustrated, detent 170 is formed in base 166 in a location corresponding to the position of clasp 158 when cover 162 is moved substantially into the closed position.

As depicted, the interior of covered embodiment 154 employs an area for resting cigarettes, cigars, or other similar smoking materials having a number of rests 126' on which to leave cigarettes, cigars or other similar smoking materials when not in active use by a smoker. When a cigarette, cigar, or other similar smoking material is placed on a rest 126', the smoke emanating therefrom is drawn down through screen 174 by the action of fan 150' which can be viewed in the cutaway portion of base 166. It will also be appreciated that the smoke emanating from a cigarette, cigar, or other smoking material is partially contained by cover 162 which enhances the effectiveness of fan 150' in drawing in most, if not all, of the smoke.

Fan 150', as depicted here, is a classic blade fan utilizing blades 178 which are angled so as to draw air and smoke down through screen 174. Fan 150' is preferably sized so as to draw substantially all of the smoke associated with a cigarette, cigar, or other similar smoking material into the device without extinguishing the smoking material.

The air and smoke drawn in through screen 174 is drawn in and then travels through base deodorizing material 66' which serves to substantially remove the odors associated with the smoke being drawn in. In this way, the air discharged from the fan is substantially deodorized when released back into the surrounding atmosphere.

As in other embodiments, opening 34' allows for the insertion of the unused portion of the cigarette, cigar or other smoking material into the feeder ridges and cutter blades for grinding and subsequent disposal. As discussed earlier, the resulting residue is substantially deodorized and more easily assimilated back into the environment when disposed of.

Rocker switch 182 is employed in this embodiment to engage the cutter bars of the device. As illustrated here, rocker switch 182 is of the type which must be held down in the on position. This type of switch is preferable for safety reasons although it will be appreciated that a number of other types of switches could be employed.

In use, switch 182 would be held in the on position while the unused portion of the cigarette, cigar, or other similar smoking material is fed through opening 34' for disposal. This configuration significantly reduces the possibility that a child could accidentally get their finger caught in the cutter bars of the device and thus substantially reduce any possibility of injury associated with the device. Also depicted is wall 183 employing louvers 184. As illustrated, louvers 184 preferably cover substantially the entire surface of wall 183. Louvers 184 are designed to allow smoke from cigarettes, cigars, or other similar smoking materials to be drawn through to a filter (shown in FIG. 11) residing behind wall 183. Louvers 184 and associated filter and fan (shown in FIG. 11) may be used in conjunction with screen 174 and fan 150', or in place of screen 174 and fan 150'. An embodiment which would utilize only screen 174 and fan 150' and in which wall 183 would be solid rather than louvered is also contemplated.

Figure 10:
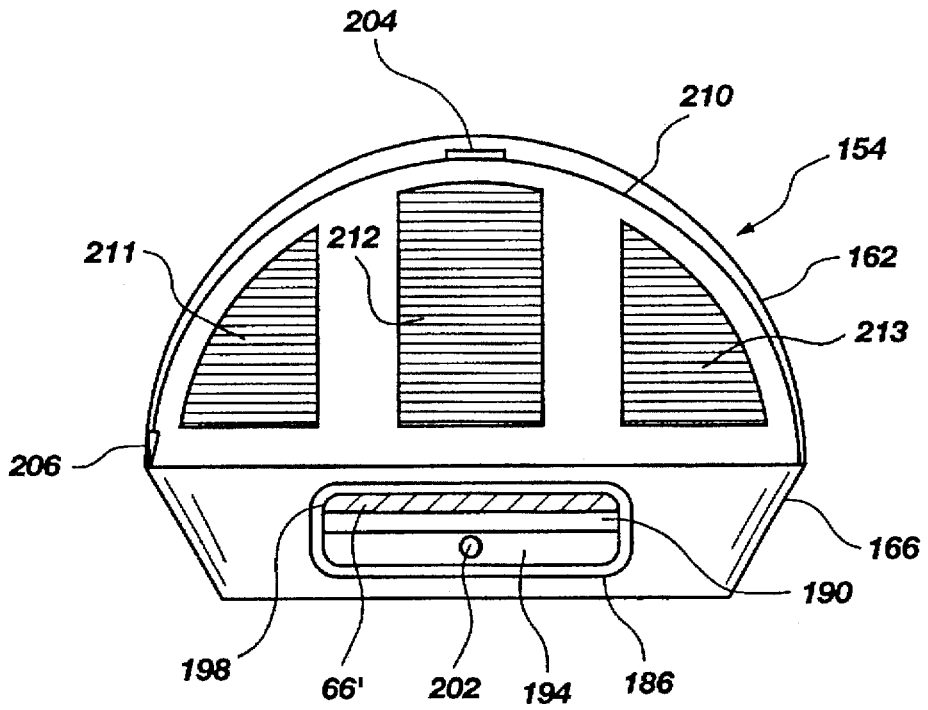
FIG. 10 is a rear view of the covered embodiment of the present invention.

Turning to FIG. 10, a rear view of covered embodiment 154 is illustrated. As depicted, a rectangular opening 186 allows access to the base deodorizing material 66', outlet 190, and tray 194. Base deodorizing material 66' is shown contained in a cartridge 198 which may be removed and replaced as necessary to maintain the desired deodorizing effect.

Outlet 190 provides a channel for the discharge of deodorized air from the fan. As described earlier, smoke and air are drawn through the screen and through base deodorizing material 66' by the action of the fan. The deodorized air is then discharged back into the surrounding atmosphere through outlet 190.

Tray 194 allows for the disposal of the ground residue of the unused portions of cigarettes, cigar, or other similar smoking materials. In use, tray 194 is removed from base 166 by pulling on knob 202. Tray 194 can then by emptied into a refuse receptacle for subsequent final disposal. If desired, tray 194 can incorporate further deodorizing materials.

Also shown in this view is filter handle 204 which allows for removal of the filter (shown in FIG. 11) associated with louvered wall (shown in FIG. 9). In embodiments which incorporate such a filter, handle 204 allows the filter to be removed and cleaned or replaced.

Switch 206 which engages the fan or fans of the system is also shown. As described earlier, switch 206 is engaged by the movement of the cover 162 over rear housing 210. This completes the circuit and allows power to flow to the fans of the system. Air is exhausted from the system through vents 211, 212, and 213.

Figure 11:
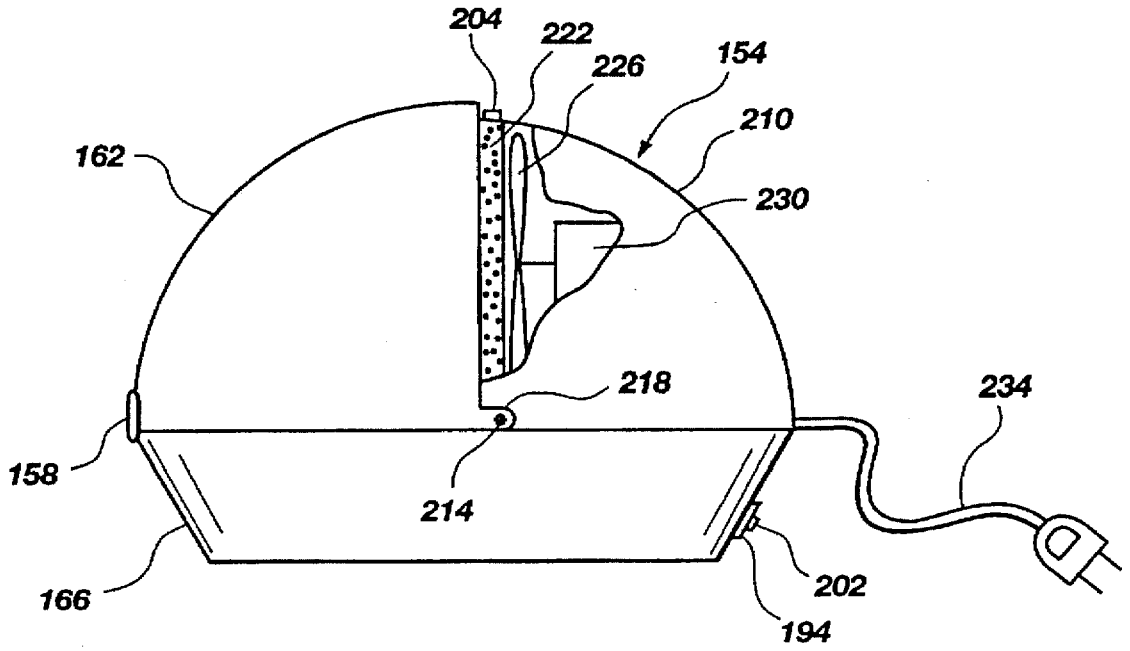
FIG. 11 is a side view of the covered embodiment of the present invention with a portion shown cut away.

A side view of covered embodiment 154 is illustrated in FIG. 11. The rotation of cover 162 over rear housing 210 is better appreciated from this view. Cover 162 rotates around pin 214 of hinge 218 residing above base 166.

In the cutaway portion of this view filter 222, which is removable via filter handle 204, is depicted. When cover 162 is in the open position fan 226, driven by motor 230, is activated. Fan 226 pulls smoke and air through filter 222 thus deodorizing any smoke present.

Power is available to fan 226 and other electrical components of covered embodiment 154 via AC power cord 234. As will be appreciated, a power cord adapted for a DC supply or battery DC power could be employed.

Also shown in this view are tray 194 and associated knob 202. Tray 194 is removable via knob 202 for disposal of the residue of cigarettes, cigars or other similar smoking materials disposed in the device of the present invention.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A device for extinguishing smoking materials comprising:

an extinguishing means for extinguishing a discarded portion of a cigarette, a cigar, or other similar smoking material;

a cutting means configured to concurrently accept, admix and grind the extinguishing means and discarded portion of a cigarette, a cigar, or other similar smoking material thereby extinguishing said smoking materials and forming a coarsely ground residue of extinguished smoking materials and extinguishing means; and electrically powered motor means for rotating the cutting means.

2. A device for extinguishing smoking materials as defined in claim 1 wherein the extinguishing means comprises a flame retardant gel.

3. A device for extinguishing smoking materials as defined in claim 1 wherein the extinguishing means comprises a moist mixture of diatomaceous earth and water.

4. A device for extinguishing smoking materials as defined in claim 1 wherein the cutting means comprises a cutting bar.

5. A device for extinguishing smoking materials as defined in claim 4 wherein the cutting bar comprises a feed means for feeding the discarded smoking material into the device for admixture with the extinguishing means and a grinding means for grinding the discarded smoking material admixed with the extinguishing means.

6. A device for extinguishing smoking materials as defined in claim 1 further comprising a deodorizing means for deodorizing the ground residue.

7. A device for extinguishing smoking materials as defined in claim 6 wherein the deodorizing means comprises an activated charcoal filter.

8. A device for extinguishing smoking materials as defined in claim 6 wherein the deodorizing means comprises diatomaceous earth.

9. A device as defined in claim 1 further comprising a storage means for storing the ground residue.

10. A device as defined in claim 1 further comprising:

a fan means for drawing smoke and air through the device;

an electrically powered motor means for operating the fan means; and a filter means for deodorizing the smoke and air drawn through the device thereby deodorizing the air released from the device.

11. A device for extinguishing and deodorizing discarded smoking materials comprising:

an extinguishing means for extinguishing a discarded portion of a cigarette, a cigar, or other similar smoking material;

a cutting means configured to concurrently accept, admix and grind the extinguishing means and discarded portion of a cigarette, a cigar, or other similar smoking material thereby extinguishing said smoking materials and forming a coarsely ground residue of extinguished smoking materials and extinguishing means;

electrically powered motor means for rotating the cutting means; and a disposal means for disposing of the ground residue into the surrounding environment.

12. A device for extinguishing smoking materials as defined in claim 11 wherein the extinguishing means comprises a flame retardant gel.

13. A device for extinguishing smoking materials as defined in claim 11 wherein the extinguishing means comprises a moist mixture of diatomaceous earth and water.

14. A device for extinguishing smoking materials as defined in claim 11 wherein the cutting means comprises a cutting bar.

15. A device for extinguishing smoking materials as defined in claim 14 wherein the cutting bar comprises a feed means for feeding the discarded smoking material into the device for admixture with the extinguishing means and a grinding means for grinding the discarded smoking material admixed with the extinguishing means.

16. A device for extinguishing smoking materials as defined in claim 11 further comprising a deodorizing means for deodorizing the ground residue.

17. A device for extinguishing smoking materials as defined in claim 16 wherein the deodorizing means comprises an activated charcoal filter.

18. A device for extinguishing smoking materials as defined in claim 16 wherein the deodorizing means comprises diatomaceous earth.

19. A device for extinguishing smoking materials as defined in claim 11 wherein the disposal means comprises a hose.

20. A device as defined in claim 11 further comprising a fan means for drawing smoke and air through the device thereby deodorizing the air released from the device and an electrically powered motor means for operating the fan means.

21. A method of disposing of smoking materials comprising the steps of:

extinguishing a discarded portion of a cigarette, cigar, or other similar smoking material by applying a flame retardant gel; and concurrently grinding the extinguished discarded portion of the smoking material and extinguishing means into a residue by electrically powered motor means.

22. A method of disposing of smoking materials as defined in claim 21 further comprising the step of holding the residue in a container for later permanent disposal.

23. A method of disposing of smoking materials as defined in claim 22 further comprising the step of including a deodorizing material in the storage container thereby to substantially eliminate all odors from the residue.

24. A method of disposing of smoking materials as defined in claim 21 further comprising the step of disposing of the residue directly into the surrounding environment.

* * * * *